United States Patent [19]

Harrison et al.

[11] 4,120,414

[45] Oct. 17, 1978

[54] SELF-VENTING CAP

[75] Inventors: Thomas S. Harrison, Deer Isle, Me.; Ross L. Doyle, Ramsey, N.J.

[73] Assignee: Sterling Drug Inc., New York, N.Y.

[21] Appl. No.: 830,107

[22] Filed: Sep. 2, 1977

[51] Int. Cl.[2] ..... B65D 51/16

[52] U.S. Cl. ..... 215/307; 222/481.5

[58] Field of Search ..... 215/307, 11 B; 222/481.5; 220/367, 85 R, 202; 137/578

[56] References Cited

U.S. PATENT DOCUMENTS

| | | | |
|---|---|---|---|
| 291,285 | 1/1884 | Breese | 137/578 X |
| 880,669 | 3/1908 | Keller | 222/481.5 |
| 1,054,146 | 2/1913 | Smirle | 222/481.5 |
| 3,672,533 | 6/1972 | McKean | 220/367 |

FOREIGN PATENT DOCUMENTS

| | | | |
|---|---|---|---|
| 1,231,139 | 4/1960 | France | 222/481.5 |
| 1,027,147 | 4/1966 | United Kingdom | 220/367 |

*Primary Examiner*—Donald F. Norton
*Attorney, Agent, or Firm*—Charles R. Fay

[57] ABSTRACT

A self-venting cap for containers of materials that produce vapor comprising a cap, a rigid tube thereon terminating at the geometrical center of the container, a fully flexible tube extending from the rigid tube, and a float at the end of the flexible tube.

5 Claims, 3 Drawing Figures

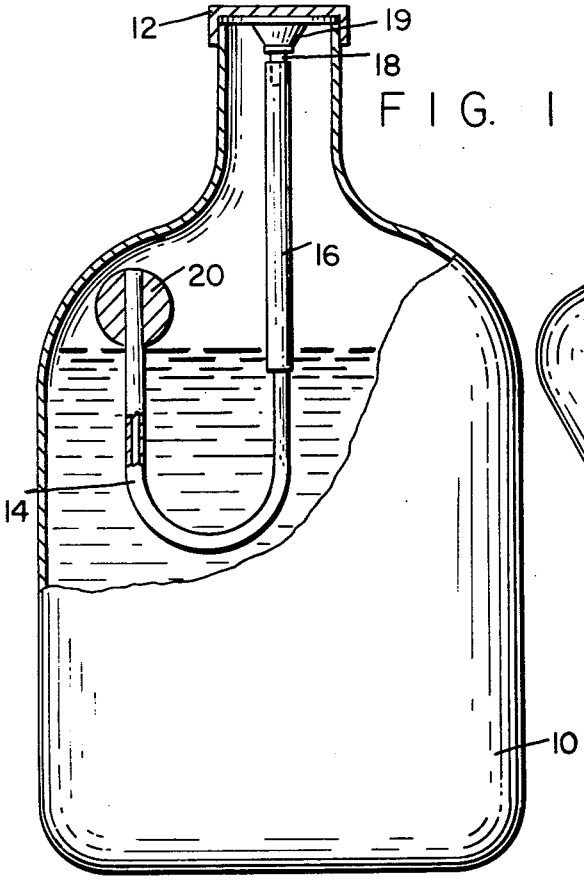
FIG. 1
FIG. 2
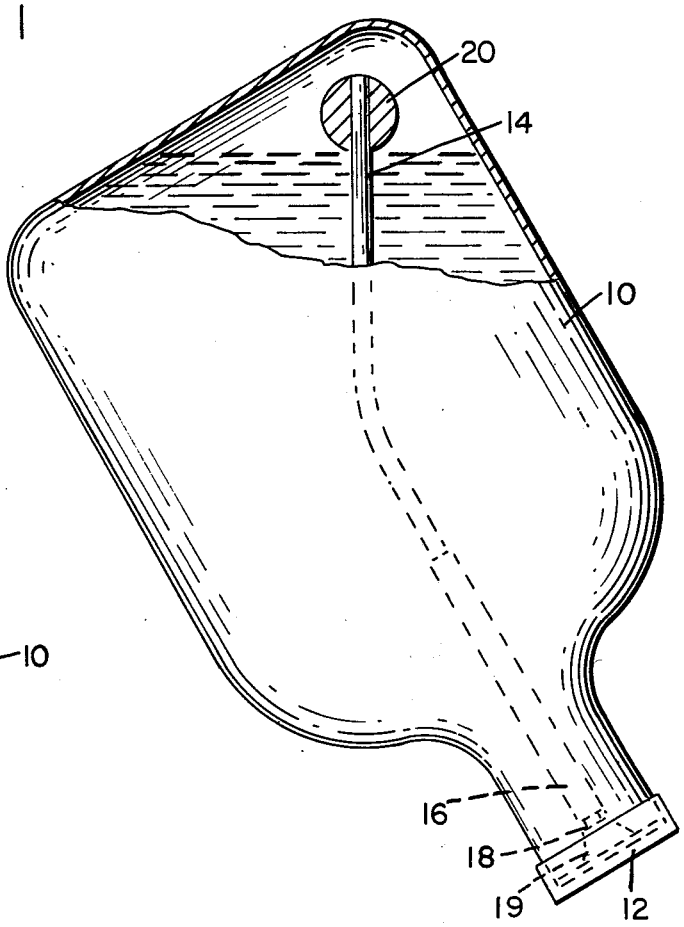
FIG. 3
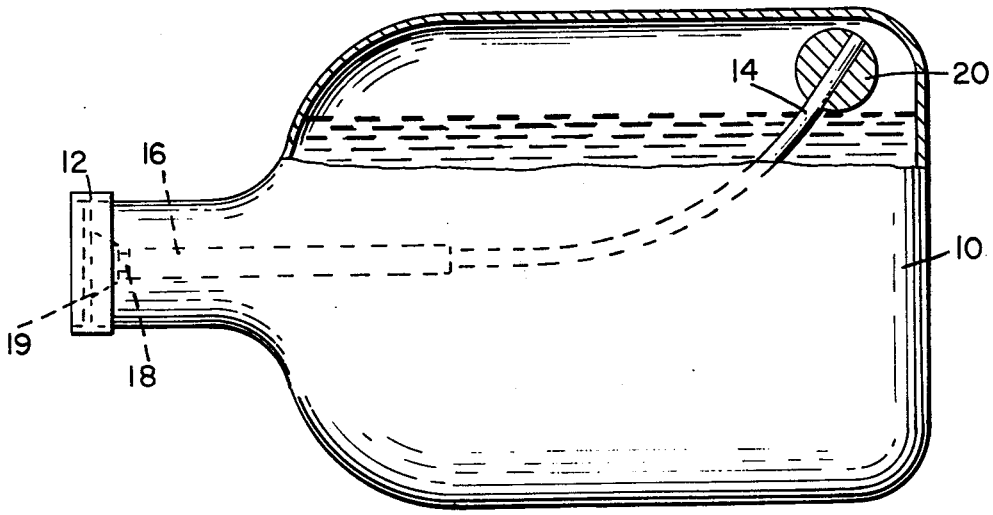

SELF-VENTING CAP

BACKGROUND OF THE INVENTION

Self-venting caps for containers have been proposed utilizing flexible tubes with floats, but these are not wholly satisfactory because when the container is on its side, or tilted, the float tends to lie on its side also, so that fluid may splash into the tube and out the vent in the cap. The present invention provides a structure for venting vapor but not liquid from a liquid filled container particularly in cases where there can be vapor evolution which could cause the container to expand or burst, and clearly this is to avoided especially with corrosive liquids.

U.S. Pat. No. 3,672,533 describes a float which maintains itself in an upright position by being relatively large requiring an unconventional bottle with a wide neck and being of a special design to keep the float floating upright like a boat through proper weight distribution. This patent discloses a closure or cap with an orifice, so that it is self-venting, i.e. to the atmosphere.

SUMMARY OF THE INVENTION

The container in this case has a self-venting cap holding in place a widened mouth having a funnel shape extending into the neck of the container and continuing in the form of a narrow stiff open ended tube to a point at the geometrical center of the container. This part of the device is held in place and does not shift relative to the container regardless of the position of the container, i.e. upright on its side, or tilted.

At the open end of the rigid tube there is attached a fully flexible tube having a length comparable to the length of the rigid tube. The flexible tube has a float at its free end and thereby causes the flexible tube to conform to the liquid content level regardless of the position of the container as the float just floats at the liquid level, when the container is normally full. The open end of the flexible tube held substantially vertical and accepts only vapor because it is held by the float at a distance above the liquid level. The float has little or no tendency to cant or lie on its side. A self-venting cap has an orifice in it to vent gasses in the container having the cap to the atmosphere.

BRIEF DESCRIPTION OF THE DRAWINGS

FIG. 1 is a view illustrating the invention when the container is upright;

FIG. 2 is a similar view showing the container on its side; and

FIG. 3 illustrates the position of float and flexible tube should the container become canted.

PREFERRED EMBODIMENT OF THE INVENTION

A cylindrical container 10 has the usual neck and a self-venting cap 12, preferably threaded to the neck, or connected in any desired way. To be self-venting, the cap has an orifice therein. Any usual shape of container or bottle may have this invention applied thereto. A fully flexible tube 14 extends from a rigid tube 16 down into the container, tube 16 having a free end approximately at the geometrical center of the container. Tube 16 may be held in rigid position by any desired or convenient means. As shown, tube 16 is attached to the reduced end of a funnel 19 which may be held in place by screwing down or otherwise attaching the self-venting cap on the funnel at the edges thereof. Tube 16 fits tightly over neck 18 and the proximate end of flexible tube 14, tube 16 remaining at all times in its original position, regardless of how the container 10 may be tilted or inclined.

A float 20 is secured to the distal free end of tube 14 without obscuring the opening thereof. The effective length of flexible tube 14 approximates the distance from the end of tube 16 to the side wall, bottom, or shoulder of the container so that the open end of tube 14 is always above the level of the liquid regardless of whether the container is upright, on its side, or tilted, as illustrated respectively in FIGS. 1, 2 and 3. Hence, this device allows the escape of vapor but not liquid.

The use of this device is only to protect the product from leaking corrosive material during shipping, storage and shelf life. The tubes 14 and 16 may be removed once the product is to be used.

We claim:

1. The combination of a liquid container with a self-venting cap wherein said cap includes a rigid tube extending to approximately the geometrical center of the container, a free-ended flexible tube in extension of the rigid tube, and a float on the flexible tube at its free end, the length of the flexible tube being sufficient to cause the float to closely approach the inside of the container at all points regardless of the relative position of the container, so that the float holds the end of the tube above liquid level at any position of the container providing for venting of any gas pressure generated from the contained liquid.

2. The combination of claim 1 wherein the tubes are removable.

3. The combination of claim 2 including means to hold the rigid tube in fixed position.

4. The combination of claim 3 wherein said means comprises a part of the cap, said part being removable.

5. A self-venting cap for a liquid container having a bottom, wall, mouth and neck, said cap comprising a part attached to the container at the mouth thereof and being removable therefrom, a rigid tube, extending from the cap part into the container, the cap part holding the tube in fixed position, said rigid tube having a distal end fixed at a generally central location in the container, a free-ended flexible tube secured to the rigid tube at its distal end, a float at the free end of the flexible tube, the length of the flexible tube being sufficient to float the free end thereof adjacent to the wall, bottom, or neck of the container depending on the disposition of the container to vent vapor only from the container.

* * * * *